US005651544A

United States Patent [19]

Stadler

[11] Patent Number: 5,651,544

[45] Date of Patent: Jul. 29, 1997

[54] DEVICE FOR AVOIDING REGISTRATION ERRORS IN A SHEET-PROCESSING MACHINE

[75] Inventor: Lothar Stadler, Eppelheim, Germany

[73] Assignee: Heidelberger Druckmaschinen AG, Heidelberg, Germany

[21] Appl. No.: 596,598

[22] Filed: Feb. 5, 1996

[30] Foreign Application Priority Data

Feb. 4, 1995 [DE] Germany ..... 195 03 739.1

[51] Int. Cl.[6] ..... B65H 5/02; B65H 9/04

[52] U.S. Cl. ..... 271/277; 271/245; 271/253; 271/254; 271/268; 101/232; 101/410

[58] Field of Search ..... 271/82, 277, 253–255, 271/268, 245–247, 85; 101/232, 409–411

[56] References Cited

U.S. PATENT DOCUMENTS

| | | | |
|---|---|---|---|
| 2,286,032 | 6/1942 | Eckhard | 271/253 X |
| 3,125,022 | 3/1964 | Reinartz et al. | 101/410 X |
| 3,417,696 | 12/1968 | Koch et al. | 101/409 |
| 3,534,683 | 10/1970 | Barthel | 254/82 X |
| 3,623,721 | 11/1971 | Smith | 271/254 |
| 3,682,472 | 8/1972 | Barthel | 271/268 X |
| 3,833,213 | 9/1974 | Smith | 271/268 X |
| 4,466,350 | 8/1984 | Schilling et al. | 101/410 |
| 5,033,732 | 7/1991 | Pollich | 271/253 X |
| 5,176,079 | 1/1993 | Pollich | 101/232 |
| 5,505,441 | 4/1996 | Sugiyama et al. | 271/268 |

FOREIGN PATENT DOCUMENTS

| | | | |
|---|---|---|---|
| 3721900 | 1/1989 | Germany | 101/409 |

*Primary Examiner*—Boris Milef

*Attorney, Agent, or Firm*—Herbert L. Lerner; Laurence A. Greenberg

[57] ABSTRACT

Device for avoiding registration errors at an oscillating pregripper of a sheet-processing machine includes a gripper bar deflectable in synchronism with the machine so that a respective sheet being processed therein undergoes stretching in a trailing region of the sheet. The gripper bar, in a middle region thereof, is guided and driven in a flexurally bending-resistant manner. A feeder cylinder carries thrust pads at both sides thereof for deflecting the gripper bar at the ends thereof in a sheet travel direction before a respective transfer of a sheet at the feeder cylinder, and for maintaining the deflection until sheet transfer has been completed.

8 Claims, 5 Drawing Sheets

DEVICE FOR AVOIDING REGISTRATION ERRORS IN A SHEET-PROCESSING MACHINE

BACKGROUND OF THE INVENTION

Field of the Invention

The invention relates to a device for avoiding registration errors in an oscillating pregripper of a sheet-processing machine, wherein a gripper bar is deflected in synchronism with the machine so that a respective sheet being processed therein undergoes stretching in a trailing region of the sheet.

The technical problem to be solved is that sheets of paper, when processed in a sheet-processing machine, such as when being printed in a multicolor printing press, become increasingly rolled down or ironed out in each successive printing unit, and as a result, at the end of the sheet, the registrations of the succeeding colors deviate increasingly from those of the first printing. This effect is called "close" or "narrow printing", because the impression is received that the successive colors are printed more closely or narrowly than the first color. In fact, at each printing, the width or breadth of the sheet of paper stretches somewhat more. This effect can be counteracted by stretching the trailing or rear region of a sheet before it is printed. German Utility Model DE-G 88 16 641.4 discloses a device of the type referred to at the introduction hereto. In that device, before a sheet supplied by the feeder is gripped by the pregripper, the latter is bent or caused to bow so that it is curved in a middle region thereof directed away from the sheet. This is achieved by means of a central stop on the feeder table which imposes this bending on the gripper bar. After the sheet has been gripped, the gripper bar bends back again and thereby stretches the sheet in a rearward or trailing region thereof. In this heretofore known device the drive of the gripper bar of the oscillating pregripper must be effected in a manner that the gripper bar is guided stably on the ends thereof by the drive. In other words, stable connections between the shaft and the gripper bar are required at both sides, a requirement which is relatively complicated and expensive.

SUMMARY OF THE INVENTION

It is accordingly an object of the invention to provide a device for avoiding registration errors of the type referred to at the introduction hereto, wherein stretching of a trailing or rear region of a sheet is attained in a relatively simple manner with a centrally suspended and driven pregripper.

With the foregoing and other objects in view, there is provided, in accordance with the invention, a device for avoiding registration errors at an oscillating pregripper of a sheet-processing machine, comprising a gripper bar deflectable in synchronism with the machine so that a respective sheet being processed therein undergoes stretching in a trailing region of the sheet, the gripper bar, in a middle region thereof, being guided and driven in a flexurally bending-resistant manner; a feeder cylinder carrying thrust pads at both sides thereof for deflecting the gripper bar at the ends thereof in a sheet travel direction before a respective transfer of a sheet at the feeder cylinder, and for maintaining the deflection until sheet transfer has been completed.

In accordance with another feature of the invention, the thrust pads are adjustable.

In accordance with a further feature of the invention, the gripper bar has stops cooperatively engaging with the thrust pads, the stops being adjustable.

In accordance with an added feature of the invention, the gripper bar and the feeder cylinder have respective mutually couplable drives, and the feeder cylinder is adjustable in circumferential direction for decoupling the drive of the gripper bar from the drive of the feeder cylinder.

In accordance with an additional feature of the invention, the thrust pads are adjustable by remote control.

In accordance with yet another feature of the invention, the stops are adjustable by remote control.

In accordance with yet a further feature of the invention, the feeder cylinder is adjustable in circumferential direction by remote control.

In accordance with a concomitant feature of the invention, props are disposed for additionally guiding the gripper bar at the sides thereof, the props being readily bendable.

As in the prior art devices, the sheet is accordingly stretched in the outer regions of the leading or front edge thereof, thereby resulting in a width or breadthwise stretching of the trailing or rear region of the sheet, in other words crosswise to the sheet travel direction. The effect of this widthwise stretching of the end of the sheet is that no significant rolling on or ironing out of the sheet and hence no significant close or narrow-printing occurs. In contrast with the aforementioned prior art, however, in the device according to the invention, the deflection or bending of the gripper bar does not occur directly after the transfer of the sheet from the feeder, but rather shortly before the transfer of the sheet to the feed cylinder. Instead of the middle region of the gripper bar, the ends thereof are bent or deflected, so that the guidance and drive of the gripper bar can be shifted to the middle thereof. In this manner, the suspension and drive can be made simpler and more economical and, in addition, less space is required for suspending and driving the gripper bar of the pregripper.

Further features provide for adjustment of the device, with the following varying options:

The thrust pads can be suspended adjustably from the feed cylinder; for example, an adjusting spindle and a clamping screw, respectively, may be provided. However, it is also possible that the gripper bar carries stops which cooperate with the thrust pads, and that these stops are adjustable. Another option is that the feed cylinder is adjustable in the circumferential direction while the drive of the gripper bar is decoupled from the drive of the feed cylinder. The adjustment can be made in a manner similar to a circumferential registration adjustment. It is possible for these adjustments to be made by remote control, for example, from the control panel of the printing press.

Other features and embodiments are, of course, also conceivable; for example, the gripper bar can be additionally guided at the sides thereof by props or supports which are relatively nonresistant to bending or deflection, i.e., are readily bendable.

Other features which are considered as characteristic for the invention are set forth in the appended claims.

Although the invention is illustrated and described herein as embodied in a device for avoiding registration errors, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
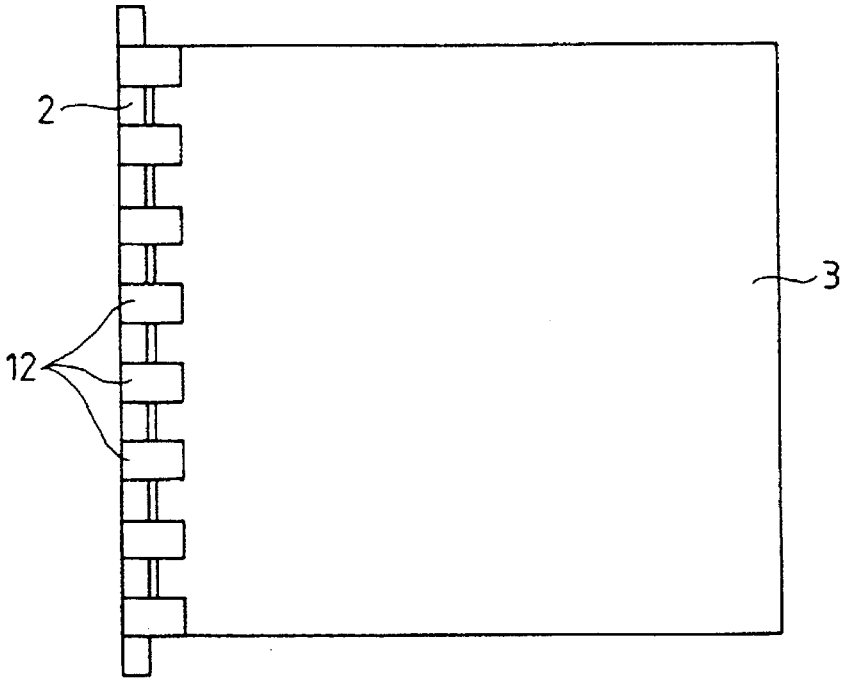
FIG. 1 is a plan view of a sheet of paper gripped by a gripper bar in accordance with the invention.
Figure 2:
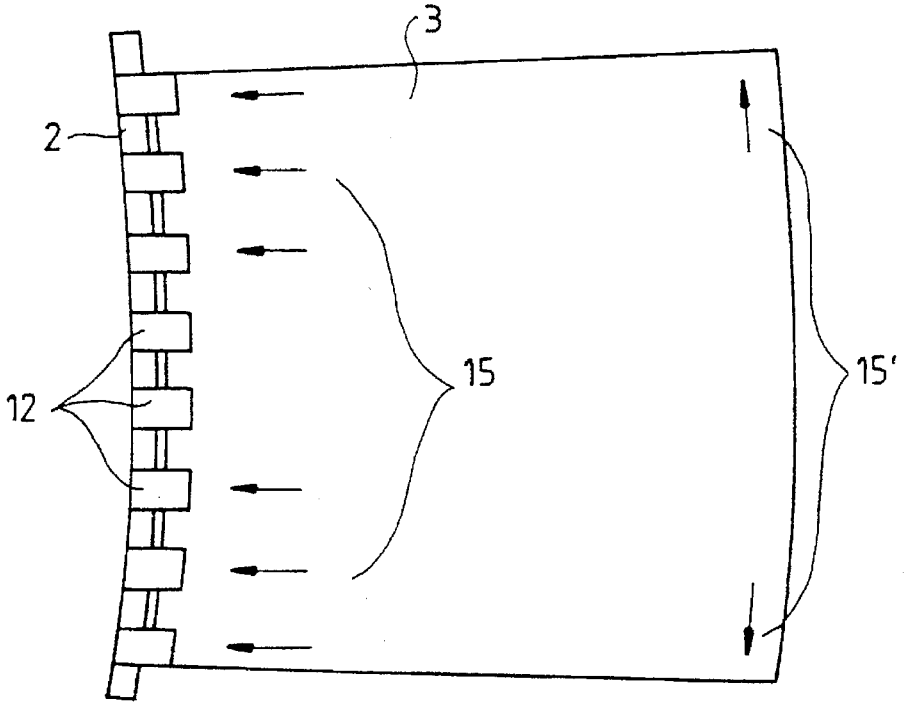
FIG. 2 is a view like that of FIG. 1 in another operating phase of the device according to the invention wherein the sheet is stretched as the gripper bar is bent or bowed.

Referring now to the drawings and, first, particularly to FIGS. 1 and 2 thereof, there is provided therein a diagrammatic illustration for explaining the operation of the device according to the invention.

FIG. 1 shows a sheet 3 after it is engaged, i.e., gripped, by a number of grippers 12 of a gripper bar 2. In this operating phase, the gripper bar 2 has not yet been bent or bowed, and the sheet 3 has not yet been stretched.

FIG. 2 shows the stretching of the sheet 3 by the bending or bowing of the gripper bar 2. The deflection is shown greatly exaggerated; in actuality, it amounts to only a few hundredths of a millimeter. This deflection takes place in such a way that the gripper bar 2 is deflected at its ends in such a manner that curvature of the gripper bar 2 occurs in a direction towards the sheet 3. As a result, forces as symbolically represented by the arrows 15 act upon the sheet 3. In the region of the front or leading edge of the sheet 3, the forces are tensile forces which increase in a direction towards the edges thereof. No tensile forces act in the middle. As a result of these tensile forces, forces occur at the rear or trailing end of the sheet which cause stretching in a direction of the width or breadth of the sheet, as symbolically represented by the two sidewise directed arrows 15'.

Figure 3:
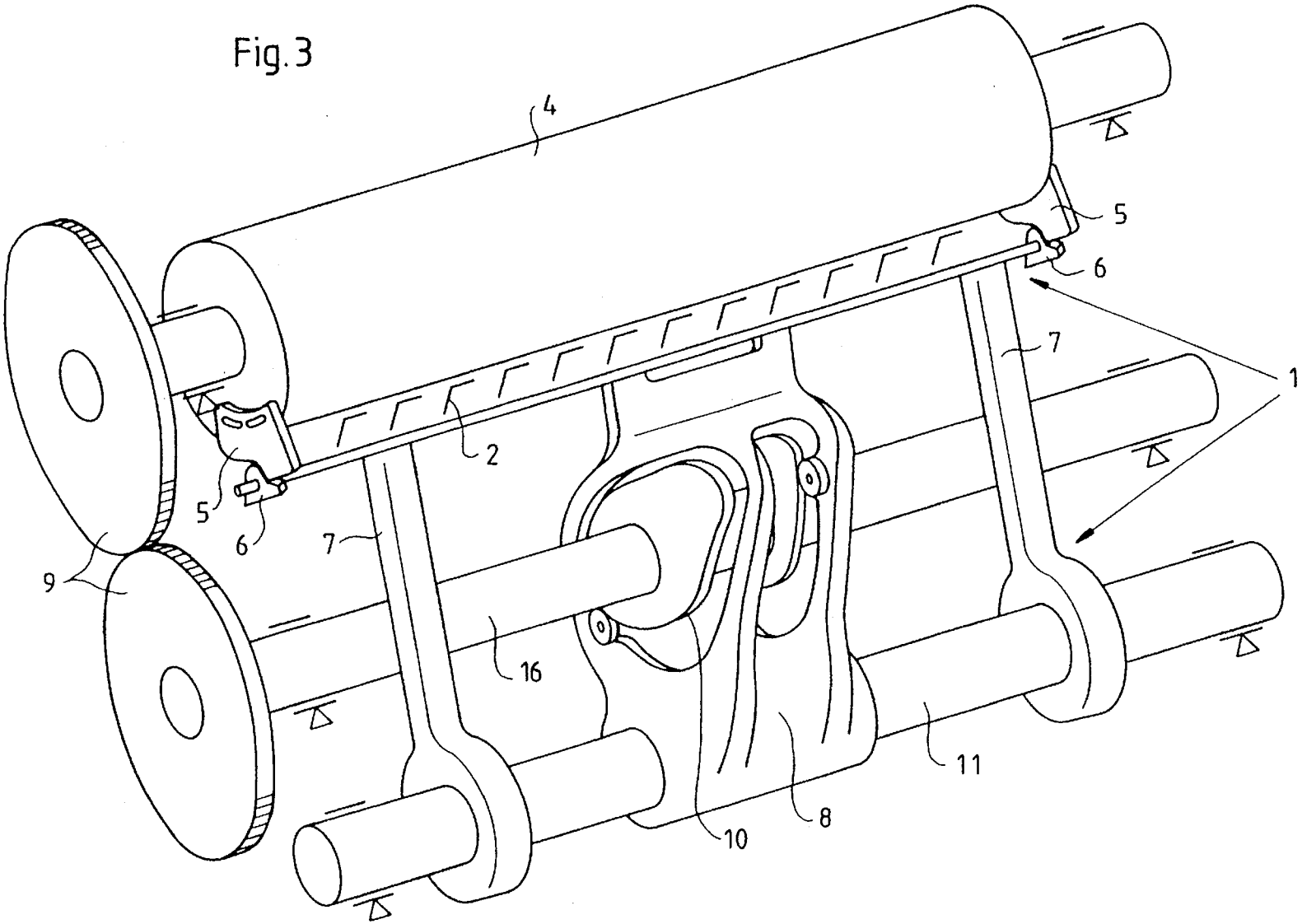
FIG. 3*a* is a perspective view of an exemplary embodiment of the device according to the invention.
FIG. 3*b* is a perspective view illustrating the remote adjustability of the stops.
FIG. 3*c* is a partial perspective view illustrating the remove adjustability of the feeder cylinder.
Figure 4:
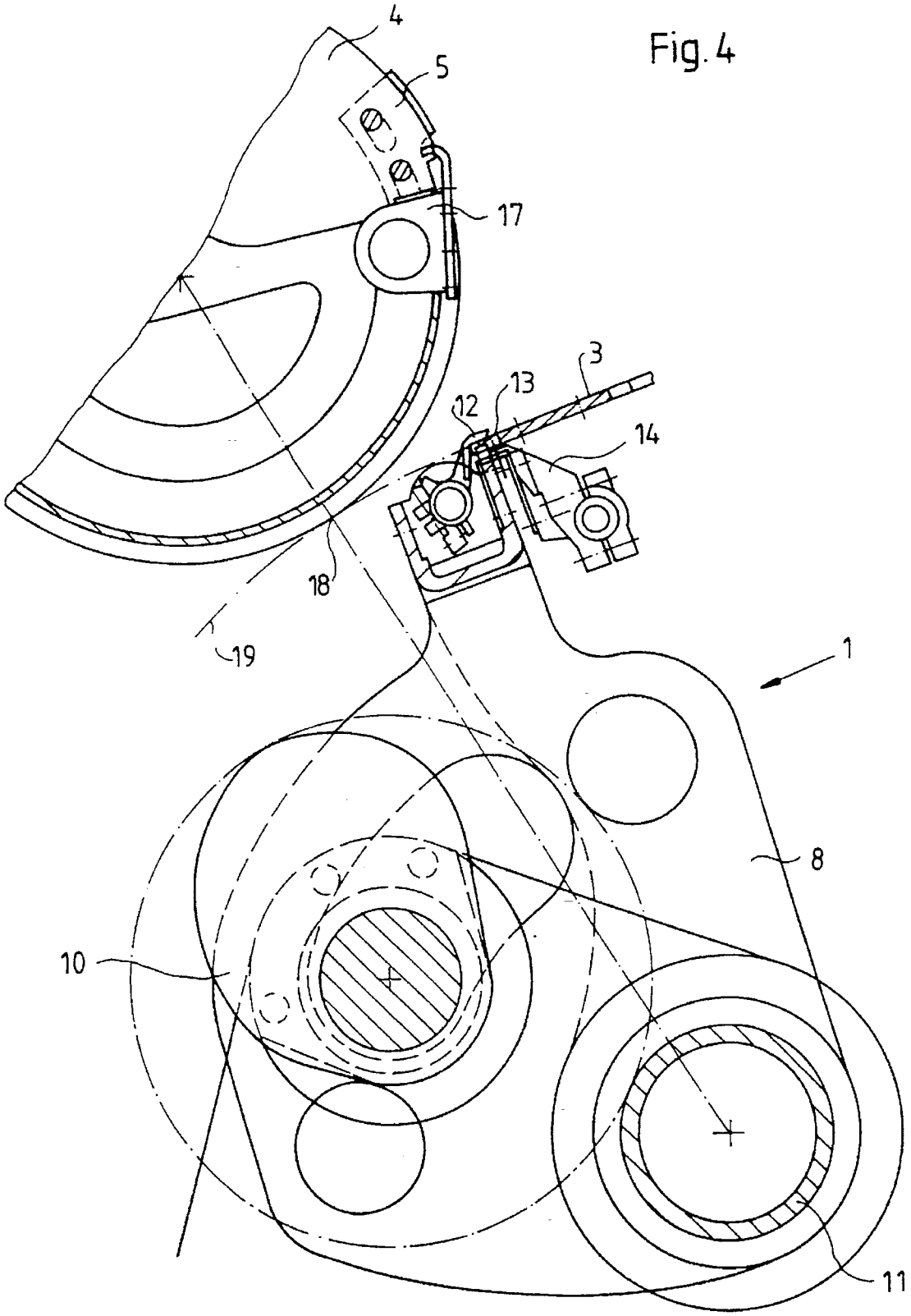
FIG. 4 is an enlarged end or side view of FIG. 3.

FIGS. 3 and 4 shows an exemplary embodiment of the invention.

Figure 3A:
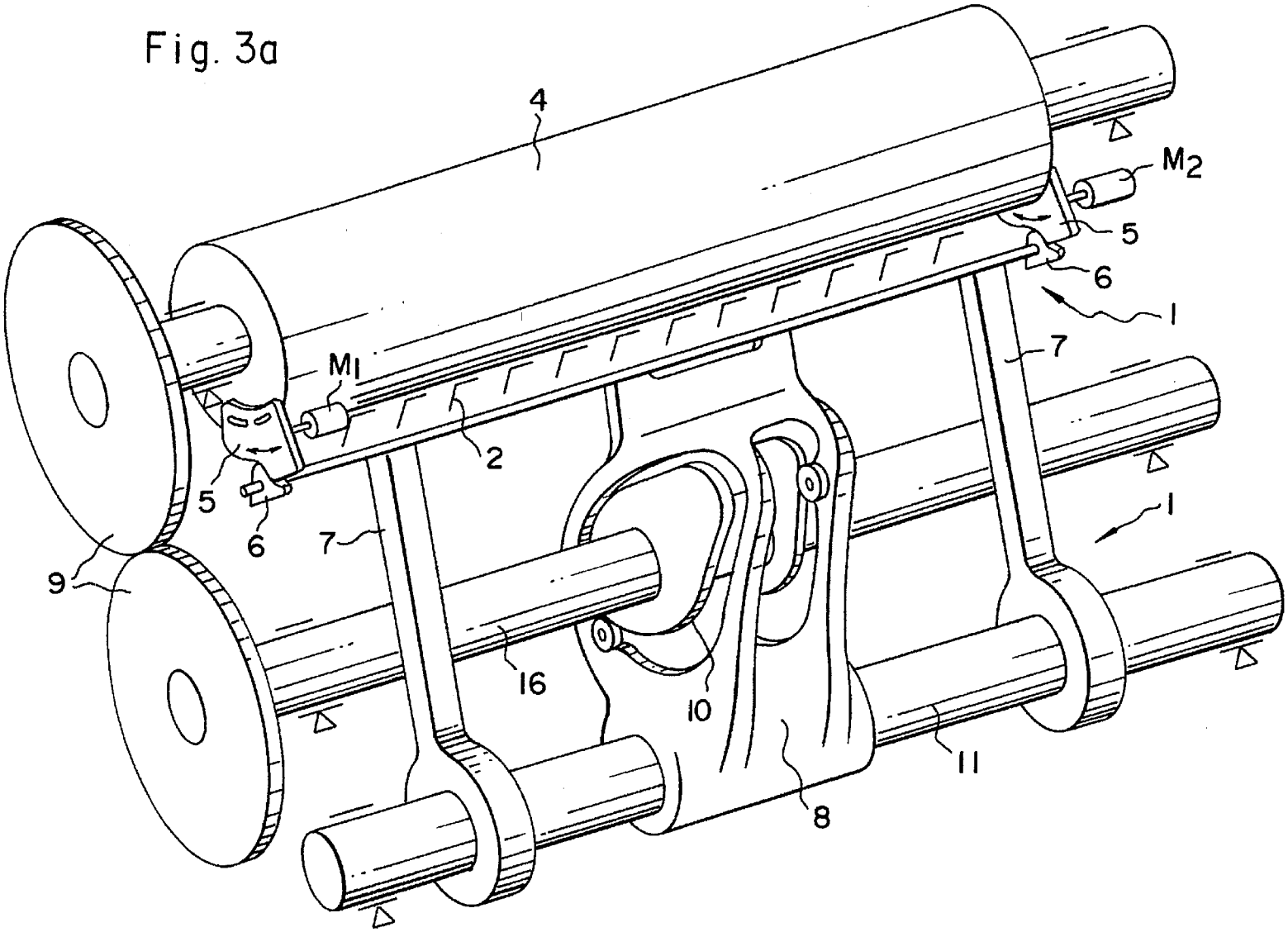
Figure 3B:
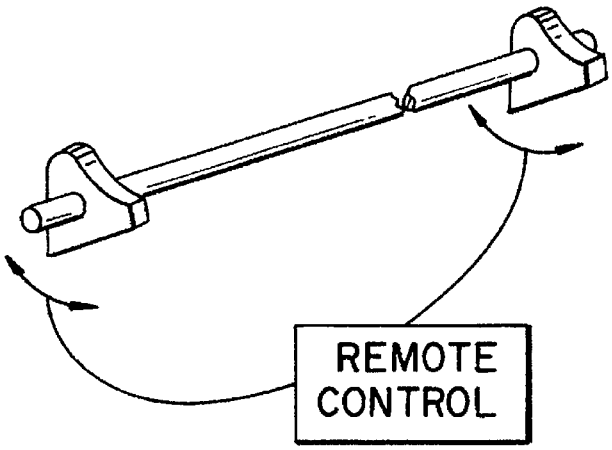
Figure 3C:
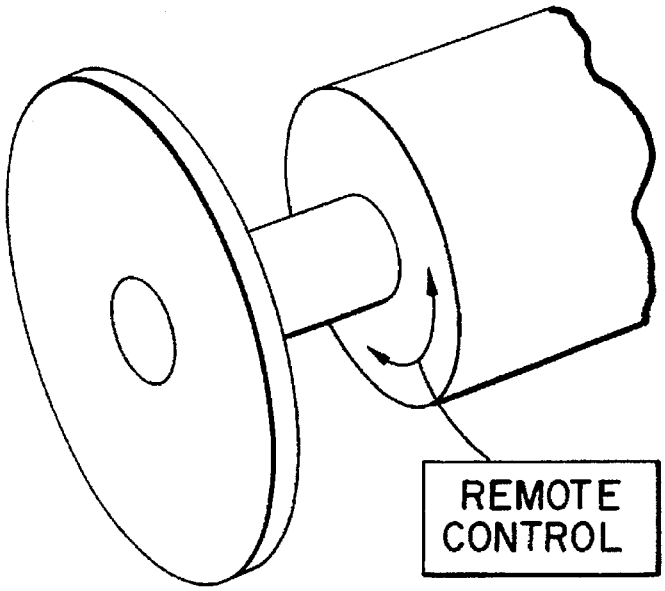

FIG. 3*a* is a front and end perspective view of the device according to the invention. The gripper bar 2 of the pregripper 1 is connected in a bending or bowing-resistant manner by means of a housing 8 to a shaft 11 and executes a swinging motion about this shaft 11. The drive is effected via driving gear wheels 9, a drive shaft 16, and a drive device 10, constructed, for example, as a cam drive. A feeder cylinder 4 likewise carries a non-illustrated gripper bar which cooperates with the gripper bar of the pregripper 1 in a way that it takes over the sheets individually and transports them farther. The pregripper 1, via the gripper bar 2 thereof, takes over the sheets 3 from a non-illustrated feeder of the printing press. The feeder cylinder 4 carries segmentally formed thrust pads 5 at outer ends thereof, these pads 5 cooperating with stops 6 of the gripper bar 2 in such a way that, before each sheet transfer, a bending or bowing deflection is imposed upon the gripper bar 2 which results in the desired stretching of the sheet 3. Selectively, either the thrust pads 5 or the stops 6 may be adjustable, as shown in FIGS. 3*a* and 3*b*, respectively, or the feeder cylinder 4 may be adjustable in the circumferential direction, as shown in FIG. 3*c*. Further, the adjustment may be made using a remote control system, as shown in the FIGS. 3*a*–3*c*. In the exemplary embodiment shown in FIG. 3*a*, the thrust pads 5 are adjustable, as represented symbolically by the oblong slots. The illustration shows two additional props or supports 7, which serve to provide better guidance of the gripper bar 2. The props 7 must be constructed as being relatively flexible or nonresistant to bending or deflection so that they permit ready bending or deflection of the gripper bar 2.

FIG. 4 shows the exemplary embodiment in an end or side view. In addition to the parts thereof mentioned hereinbefore, a front lay 14 of the feeder is shown therein, against which the sheets 3 strike and are engaged or gripped by the gripper bar 2 of the pregripper 1. The grippers 17 on the feeder cylinder 4 are also shown in FIG. 4 and are likewise formed as a row of grippers, similarly to what has already been shown with respect to the pregripper 1 of FIG. 1. However, the grippers 17 are disposed so that, upon sheet transfer, they engage between the grippers 12 and can thereby grip the sheet 3 before it is released by the grippers 12.

The function of the illustrated exemplary embodiment is as follows:

A sheet 3, arriving from the feeder, strikes the front lay 14 and is engaged or gripped thereat by the grippers 12 of the gripper bar 2 of the pregripper 1. This pregripper 1 moves along the dot-dash line 19. In the same period of time wherein the grippers 12 move up to the transfer line 18 of the sheet 3, the feeder cylinder 4 revolves in such a manner that the grippers 17 are located in the same transfer position and can take over the sheet 3. The aforedescribed bending or deflection of the gripper bar 2 by the thrust pads 5 and the stops 6 must occur at a region before the grippers 12 and the grippers 17 have reached the transfer line 18 of the sheet 3. In this way, the described stretching is imposed upon the sheet 3, and this stretching is maintained even after the grippers 17 have taken over the sheet 3 from the grippers 12. Accordingly, upon transfer of the sheet 3 from one gripper bar to the next, the sheet 3 along its way through the printing press is always transferred with the imposed stretching, thereby preventing the rolling on of the sheets 3 which produces the effect of the close or narrow printing.

I claim:

1. Device for avoiding registration errors at an oscillating pregripper of a sheet-processing machine, comprising a gripper bar deflectable in synchronism with the machine so that a respective sheet being processed therein undergoes stretching in a trailing region of the sheet, a drive arrangement, said gripper bar, in a middle region thereof, being guided and driven in a flexurally bending-resistant manner by said drive arrangement; a feeder cylinder carrying thrust pads at both sides thereof for deflecting said gripper bar at the ends thereof in a sheet travel direction before a respective transfer of a sheet at said feeder cylinder, and for maintaining the deflection until sheet transfer has been completed.

2. Device according to claim 1, wherein said thrust pads are adjustable.

3. Device according to claim 2, which further comprises a remote control system for adjusting said thrust pads.

4. Device according to claim 1, wherein said gripper bar and said feeder cylinder have respective mutually couplable drives, and said feeder cylinder is adjustable in a circumferential direction while coupling said drive of said gripper bar is decoupled from said drive of said feeder cylinder.

5. Device according to claim 4, which further comprises a remote control system for adjusting said feeder cylinder in a circumferential direction.

6. Device according to claim 1, wherein said gripper bar has stops cooperatively engaging with said thrust pads, said stops being adjustable.

7. Device according to claim 6, which further comprises a remote control system for adjusting said stops.

8. Device according to claim 1, wherein props are disposed for additionally guiding said gripper bar at the sides thereof, said props being readily bendable.

* * * * *